12/11/84 XR 4,487,673

United States Patent [19]
Steinmetz

[11] Patent Number: 4,487,673
[45] Date of Patent: Dec. 11, 1984

[54] METHOD OF MAKING A LINE CATHODE HAVING LOCALIZED EMISSIVE COATING

[75] Inventor: Carl C. Steinmetz, Trenton, N.J.

[73] Assignee: RCA Corporation, New York, N.Y.

[21] Appl. No.: 370,582

[22] Filed: Apr. 21, 1982

[51] Int. Cl.[3] ..... C25D 13/02; C25D 13/16
[52] U.S. Cl. ..... 204/181 R; 204/181 N; 427/77; 313/422; 313/337
[58] Field of Search ..... 313/337, 338, 356, 357, 313/354, 422; 427/77, 78; 204/181 N, 181 R

[56] References Cited

U.S. PATENT DOCUMENTS

| | | | |
|---|---|---|---|
| 4,026,780 | 5/1977 | Gange | 204/181 N |
| 4,100,449 | 7/1978 | Gange | 313/337 |
| 4,199,705 | 4/1980 | Anderson | 313/422 |

FOREIGN PATENT DOCUMENTS

| | | |
|---|---|---|
| 1014200 | 12/1965 | United Kingdom . |
| 1025168 | 4/1966 | United Kingdom . |
| 1290993 | 9/1972 | United Kingdom . |
| 1575530 | 9/1980 | United Kingdom . |
| 2070851A | 9/1981 | United Kingdom . |
| 2029632B | 8/1982 | United Kingdom . |

*Primary Examiner*—Leo H. Boudreau
*Assistant Examiner*—K. Wieder
*Attorney, Agent, or Firm*—Eugene M. Whitacre; Dennis H. Irlbeck; Lester L. Hallacher

[57] ABSTRACT

Electron emissive material is applied to a line cathode by surrounding the cathode with cylinders at the locations where deposition of the material is desired and voltage biasing the cylinders positive with respect to the line filament for a prescribed time.

6 Claims, 4 Drawing Figures

METHOD OF MAKING A LINE CATHODE HAVING LOCALIZED EMISSIVE COATING

BACKGROUND OF THE INVENTION

This invention relates generally to line cathodes for flat panel display devices and particularly to such a cathode having localized areas of electron emissive material and a method of making same.

U.S. Pat. No. 4,100,449 discloses a line cathode which is intended for use in a flat panel display device. The cathode includes a line filament, which preferably is tungsten. The tungsten filament is coated with a layer of electron-emissive material along the entire length and uniformly about the filament. In the operation of the cathode, the tungsten filament serves as a heater which causes electrons to be emitted from the emissive coating by the passage of current through the filament. Accordingly, the entire length of the cathode emits electrons without regard to whether or not electron emission is desirable along the entire length.

U.S. Pat. No. 4,199,705 discloses a modulator structure for use in flat panel display devices employing line cathodes of the type disclosed in the aforereferenced patent. The modulator structure includes modulation electrodes arranged in pairs which span the line cathode. Electron emission is desired from the cathode portions between the modulation electrodes so that the electrons are injected into beam guide structures for propagation along channels which compose the display device. The beam guide structures include columns of apertures along which the electron beams propagate. Accordingly, for a color flat panel display device three beams, one for each of the primary colors, are propagated along each of the channels. Electron emission is not needed, or desired, between the columns of apertures and, therefore, the modulator structure includes pairs of isolation electrodes arranged between the pairs of modulation electrodes. The isolation electrodes are voltage biased to hold the portions of the line cathode between the pairs of isolation electrodes in a cut-off mode so that electrons are not emitted into the beam guide structures between the columns of apertures.

Because electron emission is not desired between the columns of beam guide apertures, any structure which minimizes the emission of electrons in these areas would be highly desirable. The instant invention fulfills this need by the provision of a line cathode which is coated with electron emissive material only in the localized areas where electron emission is desired.

SUMMARY OF THE INVENTION

In a method of depositing electron emissive material onto localized areas of a line filament, a plurality of conductive cylinders having a width approximately equal to the desired length of the areas is coaxially arranged about the filament. The filament and the cylinders are submerged in a solution of electron emissive material. The filament is biased at a first voltage and the cylinders are biased at a second, more positive, voltage for a preselected time.

DETAILED DESCRIPTION OF THE PREFERRED EMBODIMENT

Figure 1:
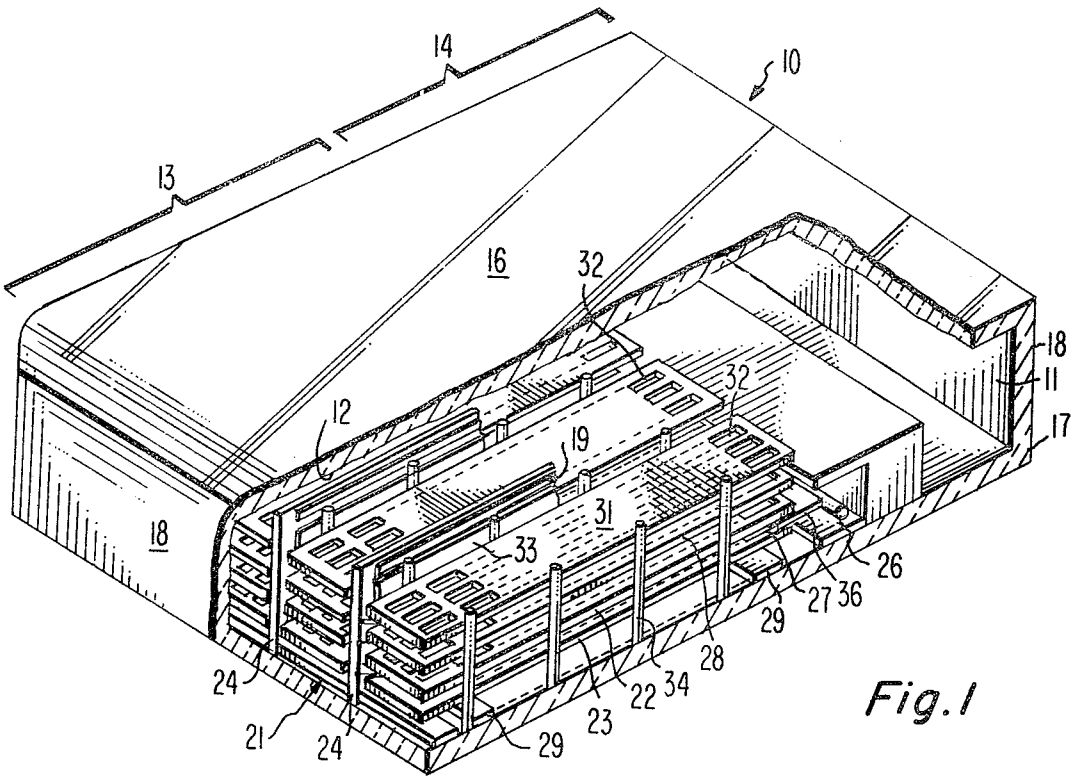
FIG. 1 is a perspective view, partially broken away, of a flat panel display device incorporating a preferred embodiment of a line cathode.
Figure 2:
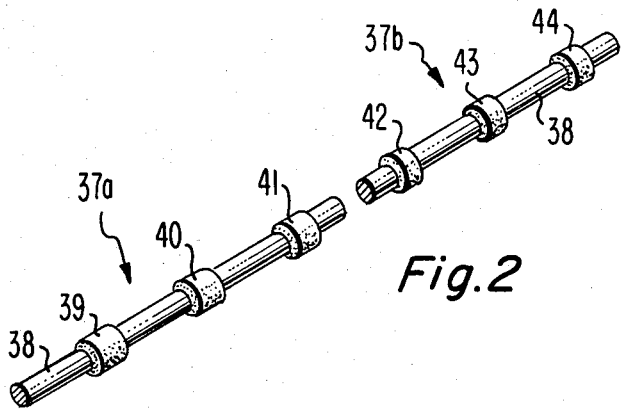
FIG. 2 shows portions of a preferred embodiment of a line cathode made in accordance with the present inventive method.

FIG. 1 shows a flat panel display device 10 incorporating a line cathode of the type shown in FIG. 2. The display device 10 includes an evacuated envelope 11 having a display section 13 and an electron gun section 14. The envelope 11 includes a frontwall 16 and a baseplate 17 held in a spaced parallel relationship by sidewalls 18. A display screen 12 is positioned along the frontwall 16 and gives a visual output when struck by electrons.

A plurality of spaced parallel support vanes 19 are arranged between the frontwalls 16 and the baseplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely, or horizontally, across the channels and longitudinally, or vertically, along the channels from the gun section 14 to the opposite sidewall 18. A cathode 26 is arranged to emit electrons into the spaces 24 between the guide mesh pairs. The guides meshes 22 and 23 include apertures 27 which are arranged in columns longitudinally along the channels 21 and in rows transversely across the channels. A focus mesh 28 is spaced above the upper guide mesh 22 in a parallel relationship therewith. A plurality of extraction electrodes 29 are arranged along the baseplate 17 to extend transversely across the channels 21 the full width of the display device 10. The extraction electrodes 29 are arranged directly beneath the rows of apertures 27 in the guide meshes 22 and 23. Appropriate biasing voltages are applied to the focus mesh 28 and the extraction electrodes 29 to cause the electrons emitted from the cathode 26 to be periodically focused between the guide meshes 22 and 23 and to propagate in the spaces 24 for the full length of the channels.

An acceleration mesh 31 is arranged in a spaced parallel relation with the focus mesh 28 and contains a plurality of apertures 32 which also are aligned in columns longitudinally of the channels and in rows transversely of the channels. Scanning electrodes 33 are arranged on both sides of the support vanes 29 so that each vane supports a scanning electrode for two adjacent channels. Insulative beads 34 engage the meshes 22, 23, 28 and 31 to retain the meshes in the desired spaced relationship.

In operation, the electron beams propagate in the spaces 24 between the guide meshes 22 and 23 until the production of one horizontal line of the visual display requires the beams to be directed toward the screen 12. Extraction of the electron beams from the spaces between the guide meshes is effected by applying a negative voltage to one of the extraction electrodes 29. The negative voltage causes the electron beams to pass through the apertures 27 in the guide meshes and the apertures 32 in the acceleration mesh 31 and the focus mesh 28. The extracted electron beams are horizontally scanned across the channels 21 by the application of varying voltages, such as sawtooth waveforms, to the scanning electrodes 33 on the sides of the support vanes 19. Every channel, therefore, is horizontally scanned between the two support vanes 19 so that each channel contributes a portion of each horizontal line of the visual display on the faceplate 16. The same line cathode supplies the electrons for every channel and each channel contributes to every horizontal line of the display.

The line cathode 26 of FIG. 1 can be of the type disclosed in U.S. Pat. No. 4,100,449; however, the use of a cathode of this type results in several disadvantages. Firstly, electron emission is desired only in the areas of the cathode which are aligned with the columns of apertures 32 in the guide meshes 22 and 23. Each of the columns of apertures serves as an electron beam guide so that three beams, one for each of the primary colors in a color display, propagate in each of the channels 24. For this reason, no emission is needed, or desired, between the columns of apertures or between the larger spaces which span adjacent channels. The modulator structure described in U.S. Pat. No. 4,199,705 is useful in preventing electron emission between the columns of apertures and between adjacent channels. However, it is nevertheless preferable to eliminate the emission of electrons in all areas where such emission is not required. During the initial activation of the cathode, large volumnes of gases are driven off. These gases must be evacuated from the envelope by use of a vacuum pump. The presence of emissive material in the areas where electron emission is not needed merely adds to the difficulty of evacuating these gases from the envelope. Additionally, larger amounts of gettering are required by the presence of the emissive material and the gettering, therefore, may not be sufficient to handle the sudden on-rush of gas.

FIG. 2 shows two portions 37*a* and 37*b* of a line cathode in accordance with the present invention. As presently contemplated, the flat panel device shown in FIG. 1 will include 40 channels each of which is one inch (2.54 cm) wide and 30 inches (100 cm) long. Accordingly, the total length of the cathode must exceed 40 inches to provide sufficient length for mounting brackets and tensioning devices. FIG. 2 shows two of the portions 37*a* and 37*b* of the line cathode which are aligned with the channels 24. The cathode includes a heater filament 38, which typically is made of tungsten and has a diameter of about 10 mils (approximately 25 microns). The portion 37*a* includes three areas 39, 40 and 41 where electron emissive material is uniformly deposited about the filament 38. The emissive areas are spaced to align with the columns of apertures in the guide meshes 22 and 23 of FIG. 1. The second portion 37*b* is similarly constructed to include emissive areas 42, 43 and 44 which also are spaced to align with the columns of apertures in one of the channels 24. The spacing between the emissive areas 41 and 42 of the portions 37*a* and 37*b* respectively is selected to span the space between adjacent channels. Each of the emissive areas 39 through 44 has a dimension along the length of the filament 38 which is determined by the transverse dimension of the apertures in the beam guides. As presently contemplated, this is in the order of 80 mils (200 microns). The spacing between adjacent emissive areas in each channel is in the order approximately 120 mils (300 microns). The spacing between the emissive areas 41 and 42 of the adjacent channels is in the order of 500 mils (1.27 cm). With these exemplary dimensions a line cathode for a flat panel device having 40 one-inch channels only approximately 30 percent of the entire length of the cathode need be emissive. Accordingly, approximately 70 percent of the emissive coating of the line cathode disclosed in U.S. Pat. No. 4,100,449 is eliminated and the difficulties of evacuating and gettering the envelope are proportionally reduced.

Figure 3:
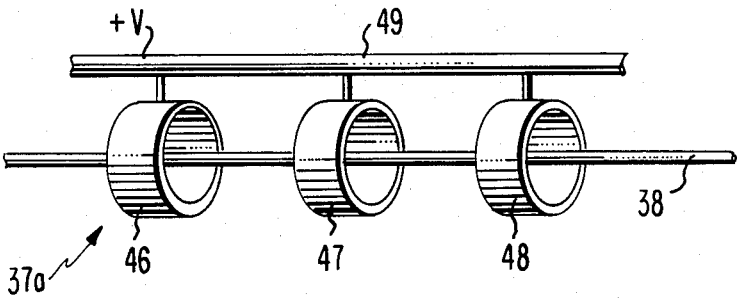
FIG. 3 shows, in simplified form, an apparatus for carrying out one method of producing the line cathode of FIG. 2.

FIG. 3 shows, in simplified form, an apparatus for carrying out a method of producing a cathode having localized emissive areas of the type shown in FIG. 2. The tungsten filament 38 is arranged concentric with conductive cylinders 46, 47 and 48 which are spaced in accordance with the spacing of the emissive areas 39, 40 and 41 of FIG. 2. Similar conductive cylinders also would be provided for all emissive areas along the entire length of the cathode. An electrode lead 49 is electrically connected to the cylinders 46, 47 and 48 so that a positive voltage V can be simultaneously applied to all the cylinders. The filament 38 also is connected to a voltage which is selected so that the voltage V applied to the input line 49 is more positive than that applied to the filament. The voltage difference between the filament 38 and the cylinders 46 through 48 is dependent upon the diameter of the cylinders and the filament as well as the rate at which the emissive coating is to be applied, and the desired thickness of the coating. The thickness of emissive coating is a function of the duration and magnitude of the applied voltage. As an example, using a diameter of 1.25 inch for the cylinders 46 through 48, setting the line 49 at +145 volts and filament 38 at ground results in a one mil (2.5 micron) coating in approximately 7 seconds. A decrease in the diameter of the cylinders permits a proportional decrease in the voltage differential. Preferably, the diameter of the cylinders 46 through 48 is held as small as physical strength and handling considerations permit in order to improve the transition of the emissive coating to the filament. A decrease in the diameter of the cylinders 46 through 48 to 0.125 inches (0.3 centimeters), permits the voltage V on the cylinders to be decreased to approximately 14 volts. Both of the above voltage/-diameter relationships result in a field gradient of approximately 50 volts/centimeter, which is in the typical range of cataphoretic deposition applications. Field gradients from about 20 volt/cm to about 100 volt/cm are typical.

In carrying out the cataphoretic disposition of the emissive material using the structure of FIG. 3, a number of cylinders equal to the number of emissive areas to be deposited are aligned and supported in a fixture. The details of the fixture are within the purview of one skilled in the art. The filament is tensioned to eliminate sag and is centered in the cylinders. The cylinders are electrically connected to a voltage source by the lead 49 so that all the cylinders can be simultaneously biased to the same voltage. The filament 38 is connected to ground or other desired potential at the same time the the cylinders are biased. The cylinders and filament are then emerged in a solution of electron emissive material of a type known in the art. For example, the solution can be carbonate comprising about 13% $CaCO_3$, 31% $SrCO_3$ and 56% $BaCO_3$. After the cylinders and filament are fully emerged, the voltages are simultaneously applied to the cylinders and the filament for the time required to deposit the emissive material to the desired thickness. The carbonate material is conductive, but highly resistive so that current flows through the material during deposition. This current can be monitored as a means of observing the thickness of material deposited on the filament 38. The emissive material is deposited on the filament 38 in the areas where field gradients are created between the filament and the cylinders, deposition is minimized in the portions of the cathode which are between the cylinders.

Figure 4:
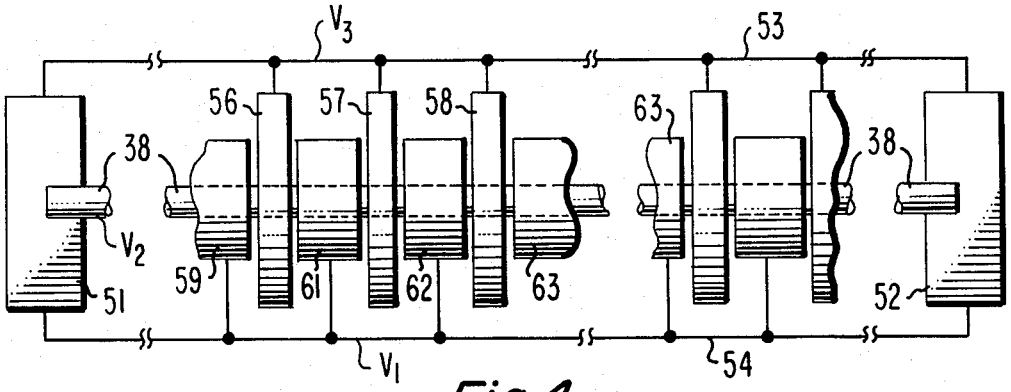
FIG. 4 shows, in simplified form, another apparatus suitable for carrying out another method of producing the line cathode of FIG. 2.

FIG. 4 shows a structure, in simplified form, for further minimizing the deposition of emissive material in the areas where electron emission is not desired. The tungsten filament 38, which is shown in several sections, is tensioned between two insulative supports 51 and 52. A physically rigid electrically conductive bus bar 53 spans the insulative supports 51 and 52 along the full length of the filament 38. A plurality of cylinders, such as 56, 57 and 58 equal in number to the number of emissive areas desired and arranged at the areas where the deposition of material is desired, are electrically connected to the bus bar 53. Another physically rigid conductive bus bar 54 extends between the insulative supports 51 and 52 and is electrically connected to a plurality of cylinders, such as 59, 61, 62 and 63 which are arranged at the areas where deposition of the electron emissive material is to be minimized. All the cylinders 56 through 63 are centered about the tungsten filament 38. The bus 54, the filament 38, and the bus 53, respectively, are biased at the voltages $V_1$, $V_2$, and $V_3$, where $V_3 > V_2 > V_1$. Typically, the diameter of the cylinders 56 through 58 can be in the order of about 0.25 inches (0.63 cm), and the diameter of the cylinder 59 through 63 can be in the order of about 125 inches (0.31 cm). The width (dimension along the filament) of the cylinders 56 through 58 is equal to the desired width of the emissive areas 39 to 44 of FIG. 2. The width of the cylinders 61 and 62 is equal to the spacing between the emissive areas within one channel, such as between 39 and 40 or 43 and 44 of FIG. 2. The width of the cylinders 59 and 63, both of which are shown broken away, is equal to the spacing between the emissive areas of adjacent channels, such as the spacing between the areas 41 and 42 of FIG. 2. Typically, $V_1$ can be 0 volts, $V_2$ in the order of 50 volts, and $V_3$ in the order of 75 volts. With these exemplary voltages, $V_2$ is more positive than $V_1$ and current flows in a direction which prohibits deposition of the emissive material onto the electrode 38 portions within the cylinders biased at $V_1$ However, the cylinders 56 to 58, are biased at the more positive $V_3$ than the filament 38 bias of $V_2$, and the emissive material is deposited onto the filament portions inside the cylinders biased at the $V_3$ voltage.

In utilizing the apparatus of FIG. 4, the entire apparatus is submerged in the emissive material with voltages $V_1$, $V_2$, and $V_3$ turned off. After the emissive material has flowed into all the cylinders to completely surround the filament 38, the voltages are simultaneously applied to all the cylinders. As explained hereinabove, the duration of the application of the voltages is dependent upon the diameters of the cylinders and the thickness of the emissive material to be deposited onto the filament 38.

What is claimed is:

1. A method of depositing electron emissive material onto localized areas of a line filament comprising the steps of arranging a plurality of conductive cylinders coaxially about said filament, said cylinders having a width approximately equal to the desired length of said areas;

submerging said filament and said cylinders in a solution of electron emissive material;

applying a first voltage to said filament and a second voltage, more positive than said first voltage, to said cylinders for a prescribed time.

2. The method of claim 1 wherein said first voltage is ground potential.

3. The method of claim 2 wherein the diameter of said cylinder and said second voltage are selected to create a field gradient of about 20 volts/cm to about 100 volts/cm between said cylinders and said filament.

4. The method of claim 1 further including the steps of arranging a second plurality of conductive cylinders coaxially about said filament, said second cylinders having a width substantially equal to the spacing between said areas, and having a diameter smaller than the diameter of first cylinders; and applying a third voltage to said second cylinder, said third voltage being less positive than said first voltage.

5. The method of claim 4 wherein said third voltage is ground potential.

6. The method of claim 5 wherein the ratio of the diameters of said cylinders in the range of about 2:1 through 3:1.

* * * * *

UNITED STATES PATENT AND TRADEMARK OFFICE

CERTIFICATE OF CORRECTION

PATENT NO. : 4,487,673

DATED : December 11, 1984

INVENTOR(S) : CARL CHARLES STEINMETZ

It is certified that error appears in the above-identified patent and that said Letters Patent is hereby corrected as shown below:

Column 5, line 31, "125" should be -- .125 --

Signed and Sealed this

*Twenty-first* Day of *May 1985*

[SEAL]

*Attest:*

DONALD J. QUIGG

*Attesting Officer* *Acting Commissioner of Patents and Trademarks*